US005967041A

United States Patent [19]

Schoenert et al.

[11] Patent Number: 5,967,041

[45] Date of Patent: Oct. 19, 1999

[54] DUAL ROLLER STENCIL APPLICATOR

[75] Inventors: Richard C. Schoenert, Hopkins; Mark E. Snetting, Eden Prairie, both of Minn.

[73] Assignee: Wagner Spray Tech Corporation, Minneapolis, Minn.

[21] Appl. No.: 09/133,738

[22] Filed: Aug. 13, 1998

[51] Int. Cl.[6] ..... B41F 5/00

[52] U.S. Cl. ..... 101/329; 101/376

[58] Field of Search ..... 101/116, 328, 101/329, 330, 331, 376, 377, 379, 380, 375

[56] References Cited

U.S. PATENT DOCUMENTS

| | | | |
|---|---|---|---|
| 2,035,127 | 3/1936 | Hinton | 101/329 |
| 2,805,436 | 9/1957 | Christensen et al. | 101/329 |
| 4,040,350 | 8/1977 | Hopkins | 101/376 |
| 4,817,526 | 4/1989 | Winston | 101/329 |
| 5,495,800 | 3/1996 | Weissbein et al. | 101/329 |
| 5,735,208 | 4/1998 | Hummel et al. | 101/329 |

FOREIGN PATENT DOCUMENTS

| | | | |
|---|---|---|---|
| 847 155 | 8/1952 | Germany | 101/329 |
| 246271 | 9/1947 | Switzerland | 101/329 |

*Primary Examiner*—Christopher A. Bennett
*Attorney, Agent, or Firm*—Faegre & Benson LLP

[57] ABSTRACT

A dual roller stencil applicator for applying a stencil pattern to a surface. The applicator has a frame with a handle supporting first and second rollers, the first roller having a porous outer layer for receiving and holding paint and a second roller having a raised stencil design thereon, with the first and second rollers in alignment and movable with respect to each other. The second roller is mounted for selective displacement from the first roller such that when the first roller is to be loaded with paint, the second roller is not in contact with the first roller, and when the apparatus is in an operating condition, the first and second rollers are urged together, permitting the first roller to supply paint to the raised stencil of the second roller. The stencil roller is completely removable from the applicator for cleaning. A drive wheel assembly is coupled to the second roller to rotate the second roller when the second roller is urged against a surface to which a stencil pattern is to be applied. The drive wheel assembly has a resilient tire with radially directed internal lugs mating with corresponding recesses in a hub on which the tire is mounted. The drive wheel assembly may be coupled to either the left or right side of the second roller. The hub has indices to allow registration of the stencil design with the surface to which it is to be applied.

15 Claims, 6 Drawing Sheets

DUAL ROLLER STENCIL APPLICATOR

BACKGROUND OF THE INVENTION

This invention relates to the field of specialty or decorating implements, more specifically, to the field of hand-held stencil applicators useful to apply a stencil pattern to a surface such as an interior wall.

DETAILED DESCRIPTION OF THE INVENTION

Figure 1:
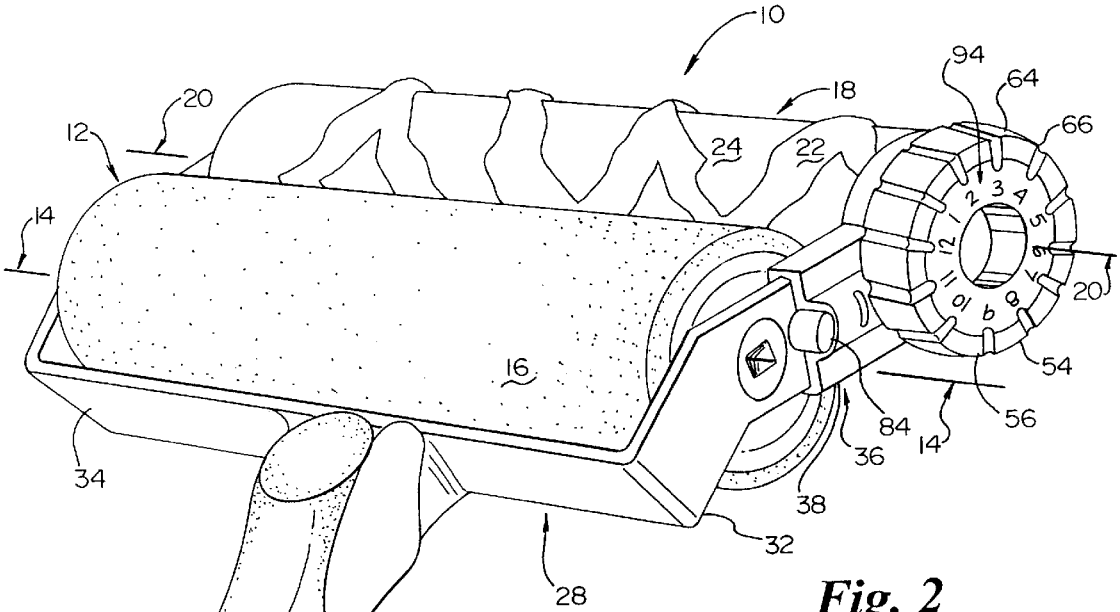
FIG. 1 is a perspective view of the dual roller stencil applicator of the present invention.

Referring to the Figures, and most particularly to FIG. 1, a dual roller stencil applicator 10 may be seen. Applicator 10 preferably has a generally cylindrical first roller 12 having an axis 14 and a porous outer surface 16 preferably made of open cell foam for receiving and storing a flowable liquid such as paint or other similar coating material. Although the roller 12 is particularly designed and intended to carry paint, it is sometimes referred to as an "inking" roller, by analogy to ink impression stencil applicators.

Applicator 10 also preferably has a generally cylindrical second roller 18 having an axis 20 parallel to axis 14 and a raised stencil pattern 22 on its outer surface 24. At least the outer surface of roller 18 is preferably made of relatively firm rubber or a similar resilient material. It is to be understood that, for simplicity, certain of the views of the stencil roller 18 are shown in a simplified cylindrical outline 26 as may be seen in FIG. 2, but that stencil roller 18 will always have a raised or embossed pattern 22 thereon. Although one pattern is illustrated in FIG. 1, it is to be understood that the present invention is not limited to the pattern shown or to any particular class or group of patterns.

Applicator 10 also preferably has a frame 28 carrying the first and second rollers 12, 18 while holding the axes 14, 20 of the first and second rollers in parallel alignment. Frame 28 has a handle 30 suitable for grasping by an operator and a pair of arms 32, 34 extending from the handle to carry the rollers 12 and 18.

Figure 2:
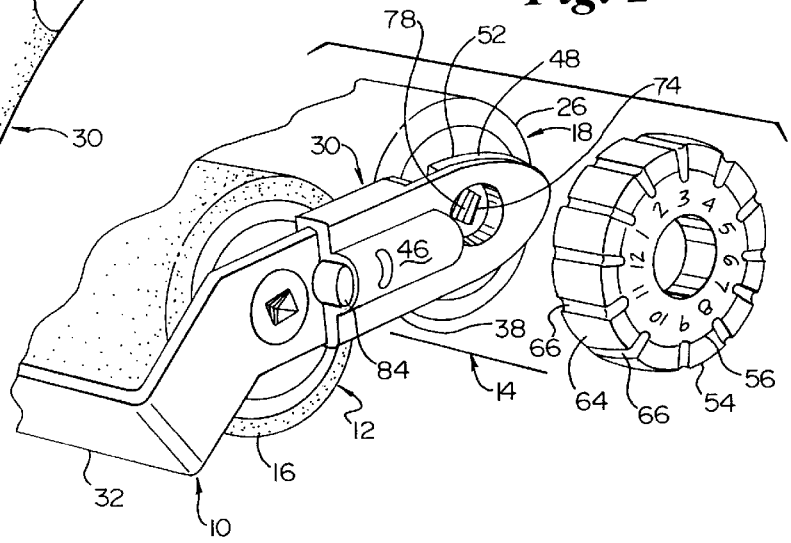
FIG. 2 is a fragmentary, partially exploded view of a portion of FIG. 1.
Figure 5:
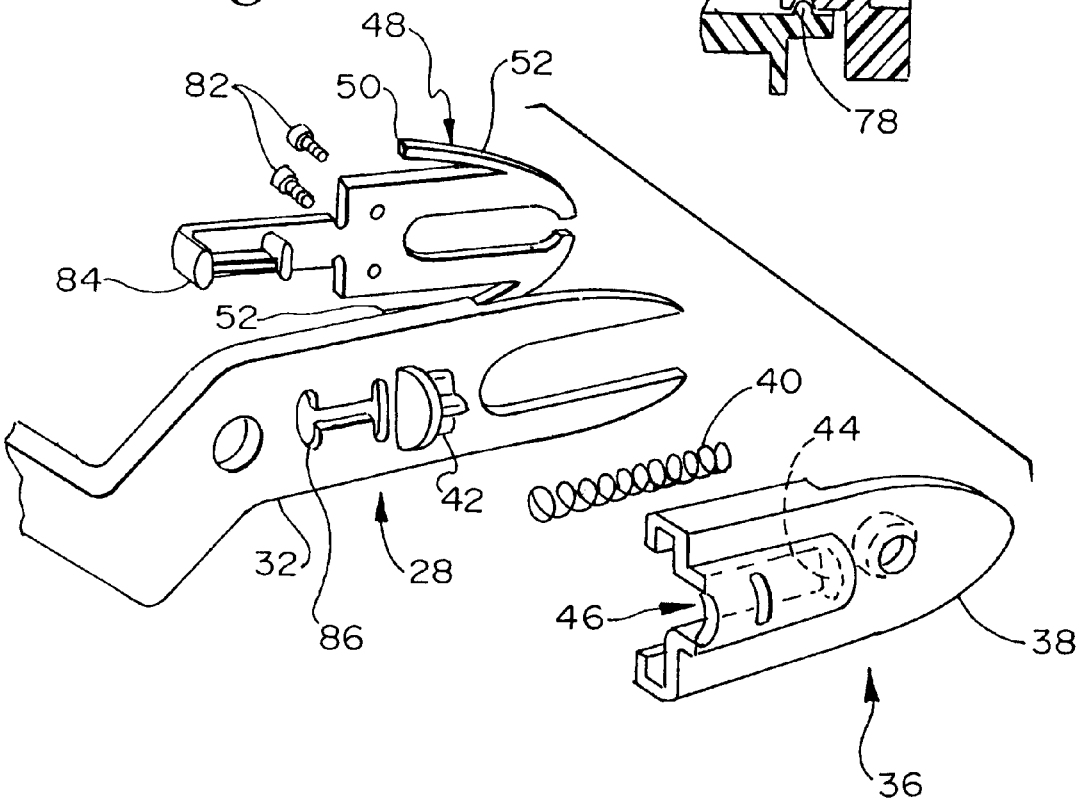
FIG. 5 is a fragmentary exploded view of a portion of FIG. 1.
Figure 7:
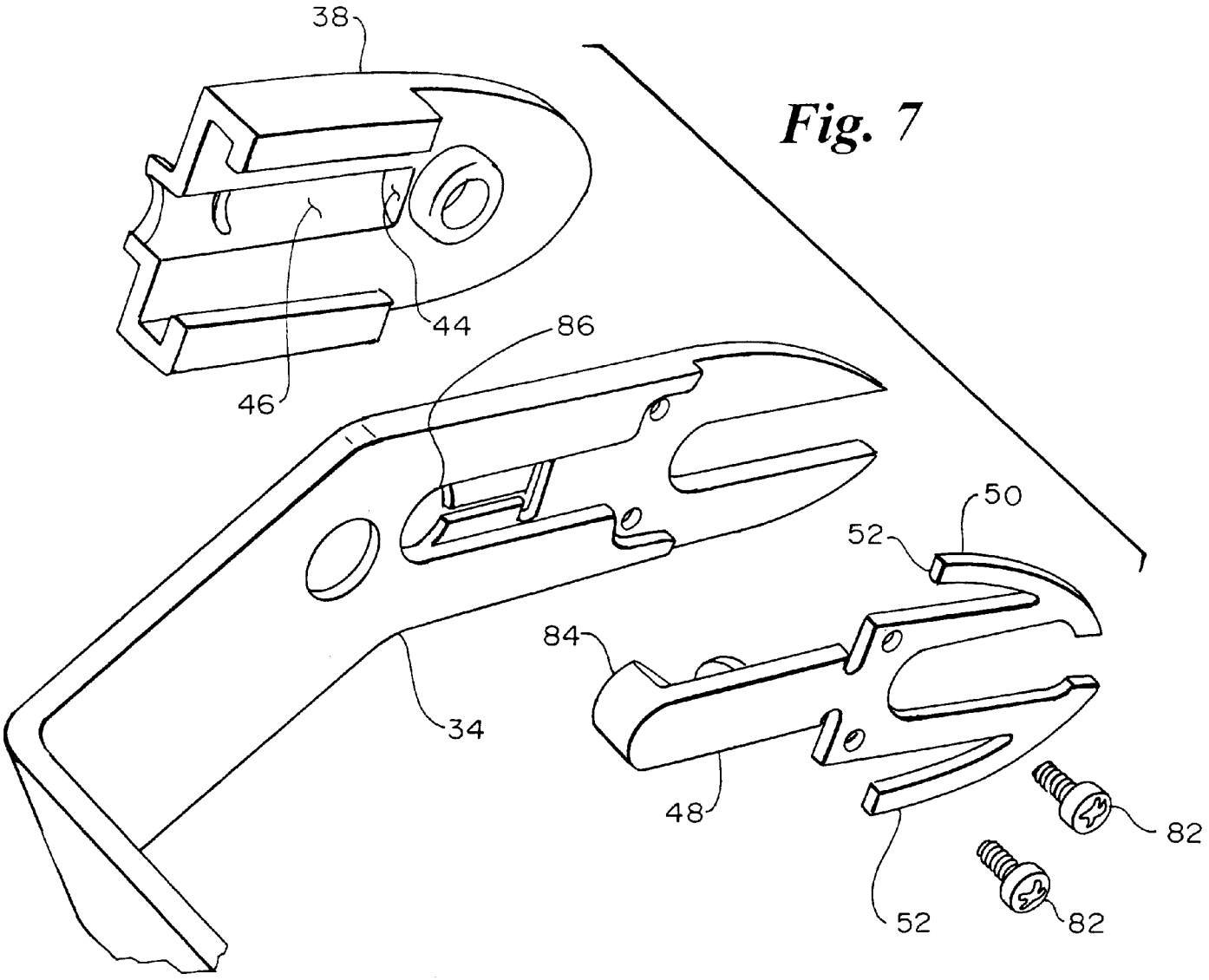
FIG. 7 is a fragmentary exploded view similar to FIG. 5, except viewed from the opposite side.

Referring now also to FIGS. 2, 5 and 7, applicator 10 has a means for urging the first and second rollers apart during paint loading, while permitting the outer surfaces of the first and second rollers to contact each other during operation so that liquid stored in the foam cover 16 of the first roller 12 is delivered to the raised stencil pattern 22 of the second roller 18. It is to be understood that the raised pattern 22 is part of the outer surface 24 of the stencil roller 18. In the embodiment shown, the means for urging the rollers 12 and 18 apart is a slide apparatus 36 having a slide member 38 and a spring 40 acting between the slide member 38 and the frame 28. More particularly, spring 40 acts between a raised projection 42 on arm 32 or 34 and a wall 44 at the end of a tunnel-like recess 46 in slide member 38.

The slide apparatus 36 may also have a latch member 48 to releasably hold the slide member 38 in a position causing the outer surfaces 16, 24 of the first and second rollers 12, 18 to be held in contact with each other. The latch member 48 is operable to release the slide member 38 to enable the spring 40 to move the rollers apart for paint loading.

The applicator 10 also preferably has means for completely releasing the stencil roller 18 from the remainder of the applicator 10, to enable changing the pattern to be applied by the applicator, and to ease cleaning of the various parts of the applicator 10. The means to completely release the stencil roller is preferably a catch member 50 which may be formed as part of the latch member 48, or may be a separate part. It is to be understood that the catch member 50 preferably is made up of two arms 52 which may be manually compressed toward each other to release the slide member 38 from the frame 28.

Figure 3:
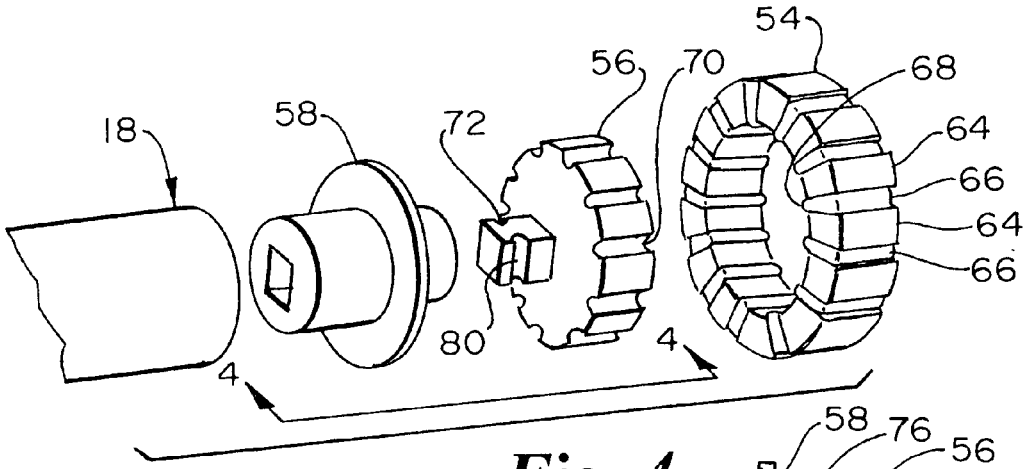
FIG. 3 is a fragmentary exploded view of a portion of the applicator of the present invention.
Figure 6:
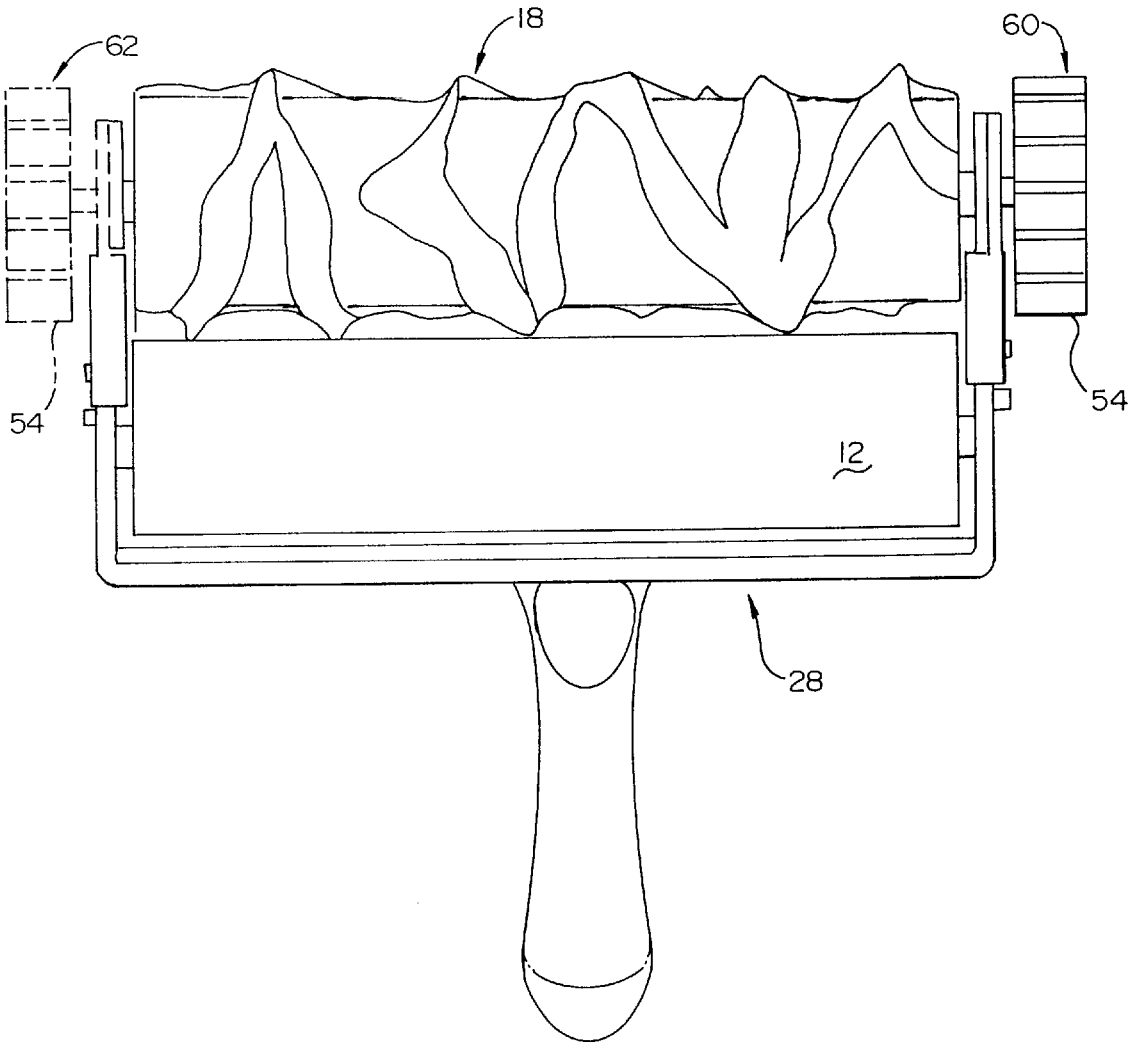
FIG. 6 is a top plan view of the applicator of FIG. 1 with the stencil roller in an operating position.

Referring now most particularly to FIGS. 1, 2, and 3, the applicator 10 also preferably has a means for driving the stencil roller 18 in the form of a resilient tire 54 mounted on a hub 56 which is drivingly connected to the stencil roller 18 through a flange 58. Referring now also to FIG. 6, it is to be understood that the driving means 54, 56 may be coupled to the right side (indicated as position 60) or the left side (indicated as position 62 in phantom) of the stencil roller 18. In operation, the drive means is positioned on the side (60 or 62) which has not yet had any stencil pattern applied to it, to avoid smearing or distorting the pattern. The dual position for the tire 54 also allows stencil patterns to be applied closer to an obstruction such as an inside corner of a wall than might otherwise be the case.

The tire 54 is preferably formed of a resilient material somewhat softer than the material on the outer surface 24 of stencil roller 18, to allow the tire to compress and provide positive traction on the surface it contacts. Additionally, tire 54 has a plurality of circumferential segments 64 spaced apart from each other by radially relieved portions 66 to allow the tire 54 to partially collapse in a radial direction when the tire is urged against a surface to which a stencil pattern is to be applied. Additionally (and referring now most particularly to FIG. 3), the tire 54 has radially inwardly projecting protrusions 68 and the hub 56 has radially inwardly projecting recesses 70 which interengage the protrusions 68 to prevent the tire 54 from circumferentially slipping on the hub 56.

Figure 4:
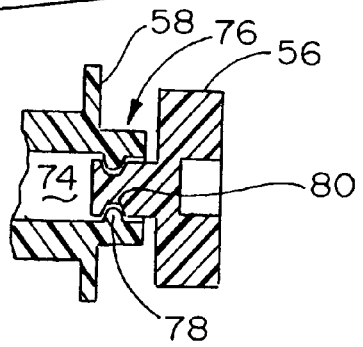
FIG. 4 is a fragmentary section view taken along line 4—4 of FIG. 3 with the parts assembled.

Referring now most particularly to FIG. 4, hub 56 also has a square cross-section, axially projecting protrusion 72 which is received in a mating cross-section recess 74 in flange 58 to transmit torque from the tire 54 to the stencil roller 18. It is to be understood that other non-circular cross-sections may be used. Furthermore, detent means 76 made up of a mating bump 78 and hollow 80 may be used to retain the hub 56 to the flange 58.

Referring now to FIGS. 5 and 7, screws 82 or other conventional fastening means may be used to secure the latch and catch member 48 to the arm 32 or 34 of frame 28. Member 48 preferably has a pushbutton 84 projecting through an aperture 86 in frame 28. A locking tab 88 projects through an aperture portion 90 and is received in an aperture 92 in slide member 38.

Figure 8:
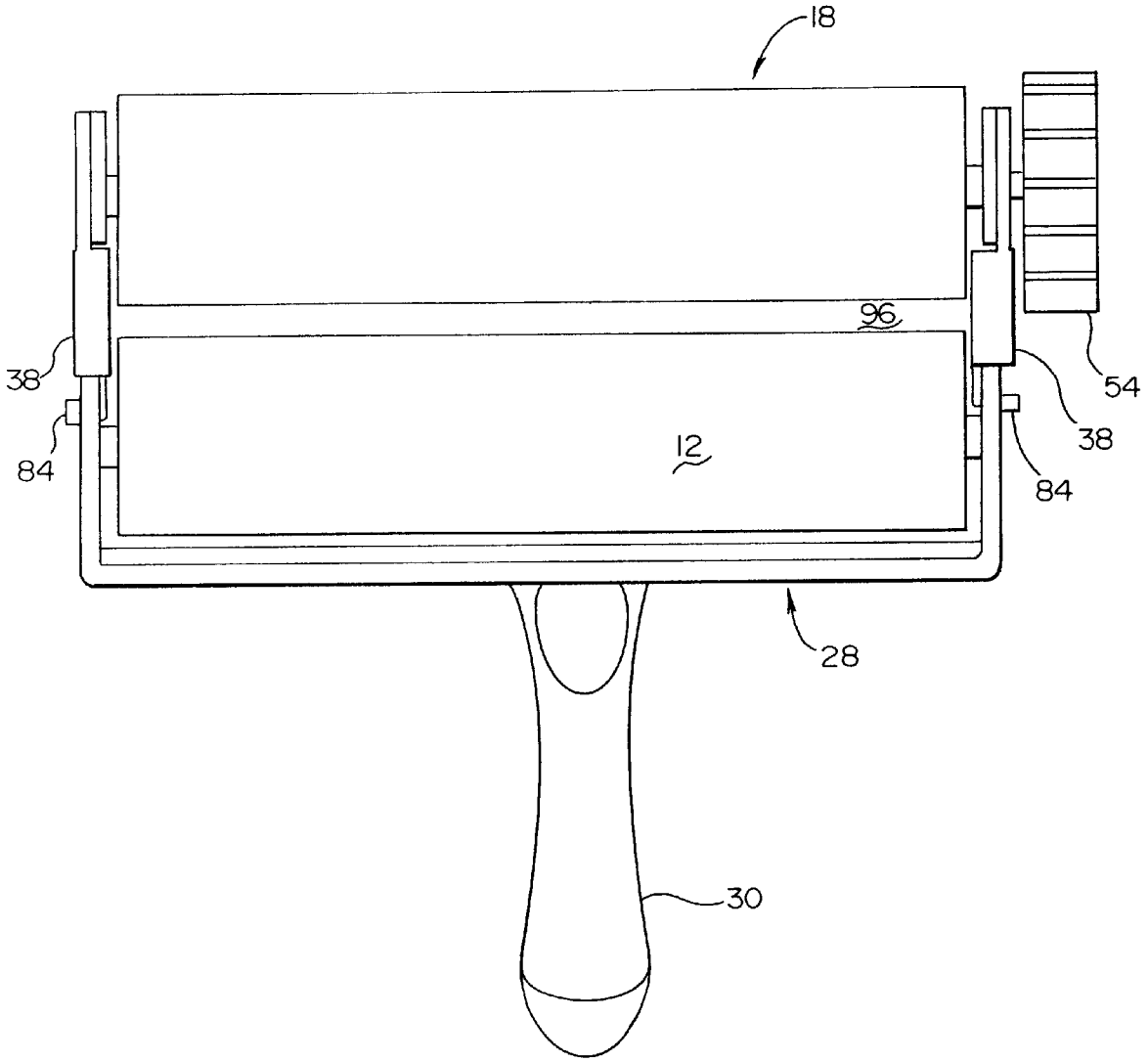
FIG. 8 is a top plan view of the applicator of FIG. 1 with the stencil roller in a paint loading position.
Figure 9:
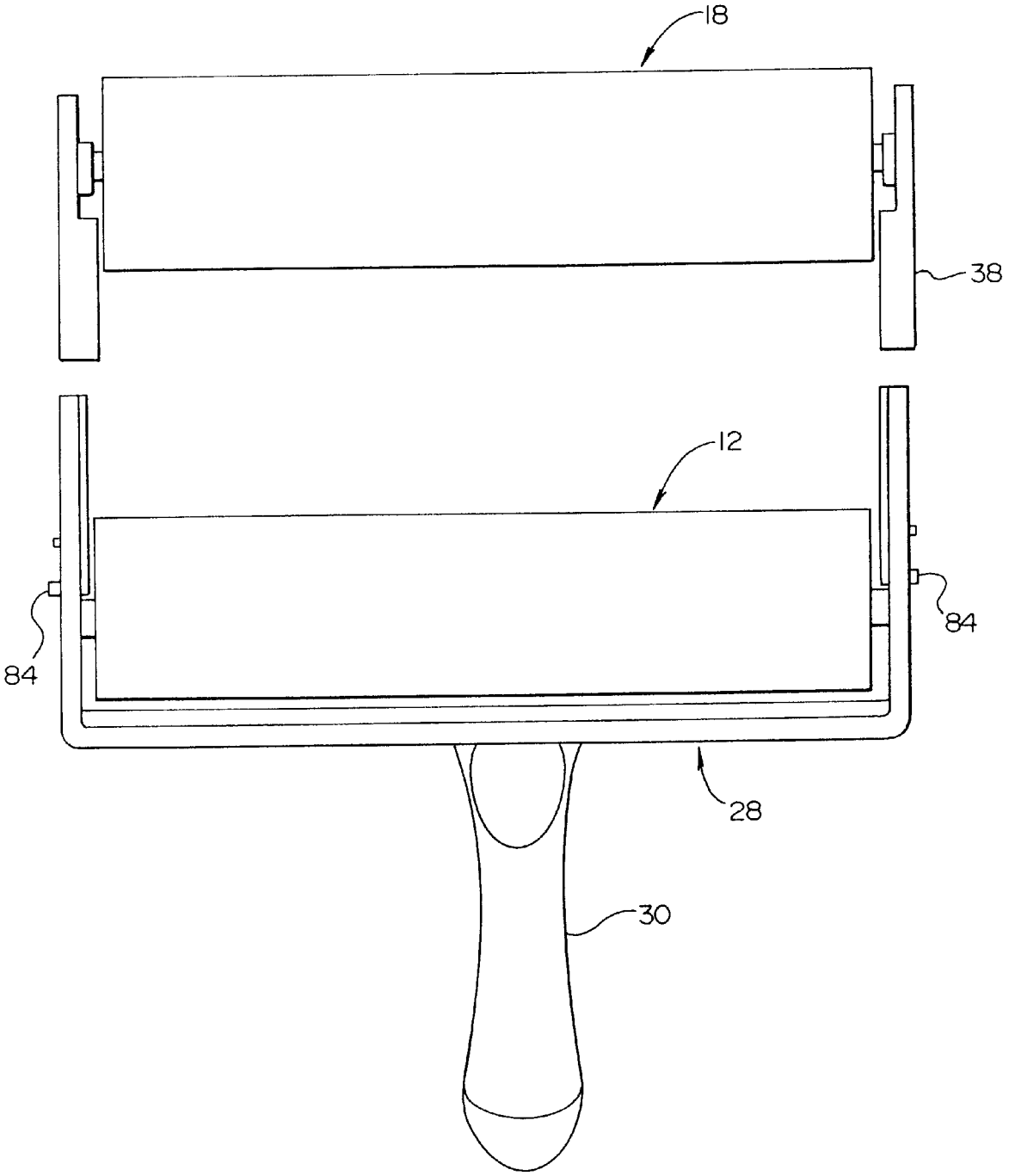
FIG. 9 is a top plan view of the applicator of FIG. 1 with the stencil roller released from the remainder of the apparatus in a condition for cleaning.

Referring now to FIGS. 1 and 6, the applicator is shown in an operating condition, where the first and second rollers are in contact with each other. In operation, the stencil roller 18 is placed against, e.g., a wall, after being indexed to the proper starting position if desired, using the index numbers 94 on the side of hub 56. At this time, tire 54 is sightly compressed on a dry (unstenciled) portion of the wall, to give traction. Applicator 10 is then moved along the wall, preferably in a direction perpendicular to the axis 14, to apply a stencil pattern to the wall, with the "inking" roller 12 resupplying paint to the raised portion 22 of the stencil roller 18. When it is necessary to replenish or reload the "inking" roller 12 with paint, pushbuttons 84 are depressed, releasing tabs 88 from recesses or apertures 92 in each slide member 38. Springs 40 will then move the stencil roller 18 away from roller 12, as shown most clearly in FIG. 8. The operator may then reverse the grasp on handle 30 to invert the applicator 10 from the position shown in FIG. 1, at which time the inking roller 12 may be rolled in a paint tray (not shown) to reload the applicator with paint. Because of the gap 96 between the rollers in this condition, no paint will be added to stencil roller 18 until the slide members 38 are grasped and urged along arms 32, 34 of frame 28 toward the handle 30, at which time the locking tabs 88 will enter respective apertures 92, moving the applicator 10 to the operating condition shown in FIGS. 1 and 6.

When it is desired to remove stencil roller 18 entirely from applicator 10, pushbuttons 84 are depressed, releasing the locking tabs 88. Arms 52 are then compressed sufficiently to allow slide members 38 to move past catch member portions 50, freeing the stencil roller 18 from the remainder of the applicator 10. Because of the curvature of arms 52, when it is desired to reinstall a stencil roller 18, slide members 38 may be moved onto arms 32, 34 over arms 52 until the slide members are past the arms, retaining the stencil roller in the "reloading" or operating position, as desired.

The invention is not to be taken as limited to all of the details thereof as modifications and variations thereof may be made without departing from the spirit or scope of the invention.

What is claimed is:

1. A dual roller stencil applicator comprising:

a) a generally cylindrical first roller having an axis and a porous outer surface for receiving and storing a flowable liquid paint;

b) a generally cylindrical second roller having an axis and a raised stencil pattern on an outer surface;

c) a frame holding the axes of the first and second rollers in parallel alignment;

d) means for urging the first and second rollers apart during loading and for permitting the outer surfaces of the first and second rollers to contact each other during operation such that the liquid paint stored in the porous outer surface of the first roller is delivered to the raised stencil pattern of the second roller; and e) a resilient tire adjacent and drivingly connected to the second roller by frictional contact between the tire and a surface to which an image of the stencil pattern is to be applied.

2. The applicator of claim 1 wherein the means for urging the rollers apart comprises a slide apparatus mounted on the frame.

3. The applicator of claim 2 wherein the slide apparatus comprises a slide member urged by a spring acting between the slide member and the frame for urging the slide along the frame in a direction wherein the axes of the first and second rollers move apart.

4. The applicator of claim 3 wherein the slide apparatus further comprises a latch member to releasably hold the slide member in a position such that the outer surfaces of the first and second rollers are held in contact with each other, the latch member operable to release the slide member, enabling the spring to move the rollers apart for paint loading.

5. The applicator of claim 1 further comprising means for completely releasing the second roller from the remainder of the applicator.

6. The applicator of claim 5 wherein the means for completely releasing comprise a catch member selectively operable to release the second roller from the remainder of the applicator.

7. The applicator of claim 6 wherein the second roller is carried on the frame by a slide member and the catch member is operable to release the slide member from the frame.

8. The applicator of claim 1 wherein the tire is carried by a hub drivingly connected to the second roller.

9. The applicator of claim 1 wherein the tire comprises a plurality of circumferential segments spaced apart from each other by radially relieved portions to allow the tire to partially collapse in a radial direction when the tire is urged against a surface to which a stencil pattern is to be applied.

10. The applicator of claim 8 wherein the hub and tire have at least one set of a radially directed interengaging protrusion and recess to prevent the tire from circumferentially slipping on the hub.

11. The applicator of claim 1 wherein the means for driving the second roller is selectively connectable to the second roller at a first end thereof and is repositionable to drive the second roller at a second end thereof.

12. The applicator of claim 11 wherein the means for driving the second roller comprises:

i) a support flange carrying the second roller, and ii) a hub carrying a tire for engagement with the surface to which a stencil pattern is to be applied with the hub and flange having a mating non-circular protrusion and recess to transmit torque from the tire to the second roller.

13. The applicator of claim 12 wherein the mating non-circular protrusion and recess each have a square cross-section.

14. The applicator of claim 12 wherein the mating non-circular protrusion and recess have detent means to retain the hub to the flange.

15. The applicator of claim 12 further comprising slide means and wherein the hub projects through the slide means to engage the flange.

* * * * *